US012122629B2

(12) United States Patent
Araki et al.

(10) Patent No.: US 12,122,629 B2
(45) Date of Patent: Oct. 22, 2024

(54) PRINTING APPARATUS

(71) Applicant: CANON KABUSHIKI KAISHA, Tokyo (JP)

(72) Inventors: Ryosuke Araki, Kanagawa (JP); Tsutomu Obata, Tokyo (JP); Yoshiaki Suzuki, Chiba (JP); Kenji Shimamura, Saitama (JP); Ryoya Shinjo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/484,353

(22) Filed: Sep. 24, 2021

(65) Prior Publication Data

US 2022/0097996 A1 Mar. 31, 2022

(30) Foreign Application Priority Data

Sep. 30, 2020 (JP) ..... 2020-166107

(51) Int. Cl.
*B65H 31/26* (2006.01)
*B65H 35/04* (2006.01)

(52) U.S. Cl.
CPC ..... *B65H 31/26* (2013.01); *B65H 35/04* (2013.01); *B65H 2301/512125* (2013.01)

(58) Field of Classification Search
CPC ..... B65H 31/26; B65H 35/04; B65H 2301/512125; B65H 31/00; B65H 31/04; B65H 31/08; B65H 31/10
See application file for complete search history.

(56) References Cited

U.S. PATENT DOCUMENTS 2,235,347 A * 3/1941 Zahutnik ..... B65H 31/36 271/223
2,456,004 A * 12/1948 Larkin ..... B21B 39/002 271/223
2,626,800 A * 1/1953 Martin ..... B65H 29/20 271/193

(Continued)

FOREIGN PATENT DOCUMENTS

JP 11-263511 A 9/1999
JP 2014-048530 A 3/2014

(Continued)

OTHER PUBLICATIONS

U.S. Appl. No. 17/488,477, Tsutomu Obata Yoshiaki Suzuki Kenji Shimamura Ryoya Shinjo Ryosuke Araki, filed Sep. 29, 2021.

(Continued)

*Primary Examiner* — Thomas A Morrison
(74) *Attorney, Agent, or Firm* — Venable LLP

(57) ABSTRACT

A printing apparatus includes a stacking portion on which a print medium printed by a printing unit configured to perform printing is stacked, a discharge unit configured to convey the print medium printed by the printing unit to the stacking portion, a passage forming portion arranged above the stacking portion so as to face the stacking portion and configured to form a discharge passage of the print medium together with the stacking portion, and an outlet port located at a downstream end of the discharge passage in a conveying direction of the print medium. In the outlet port, the passage forming portion extends to the downstream side of the stacking portion in the conveying direction.

12 Claims, 8 Drawing Sheets

(56) References Cited

U.S. PATENT DOCUMENTS 2,661,949 A * 12/1953 Bauer ..... B21B 39/002 292/216
2,761,682 A * 9/1956 Buccicone ..... B21B 39/002 271/224
2,821,391 A * 1/1958 Buccicone ..... B65H 29/30 271/224
3,052,467 A * 9/1962 Fertig ..... G06K 13/12 414/794.8
3,460,825 A * 8/1969 Mets ..... G06K 15/16 493/411
4,146,218 A * 3/1979 Loftus ..... G06K 13/16 271/220
4,157,177 A * 6/1979 Strecker ..... B65H 29/32 414/793.1
4,926,265 A * 5/1990 Yamazaki ..... H04N 1/00676 346/24
4,975,781 A * 12/1990 Hirose ..... B26D 7/015 346/24
5,145,159 A * 9/1992 Vits ..... B65H 31/32 270/58.33
5,149,218 A * 9/1992 Iwatani ..... B65H 1/24 400/625
5,646,720 A * 7/1997 Song ..... G03G 15/6529 399/361
9,403,654 B2 8/2016 Kawamoto et al.
10,294,060 B2 * 5/2019 Hashimoto ..... G03G 15/6552
2002/0001072 A1 * 1/2002 Suzuki ..... B41J 13/106 355/29
2017/0269514 A1 * 9/2017 Hara ..... G03G 15/1615
2021/0276348 A1 9/2021 Suto et al.

FOREIGN PATENT DOCUMENTS

JP 2015-105158 A 6/2015
JP 2016-005983 A 1/2016
JP 2016-101992 A 6/2016

OTHER PUBLICATIONS

U.S. Appl. No. 17/488,510, Yoshiaki Suzuki Tsutomu Obata Kenji Shimamura Ryoya Shinjo Ryosuke Araki, filed Sep. 29, 2021.
Office Action dated Jul. 26, 2024, in Japanese Patent Application No. 2020-166107.

* cited by examiner

PRINTING APPARATUS

BACKGROUND OF THE INVENTION

Field of the Invention

The present invention relates to a printing apparatus.

Description of the Related Art

There has been proposed a printing apparatus including a stacking portion used to stack a printed print medium. A user can take out the print medium from an outlet port communicating with the stacking portion. The print medium may curl depending on its characteristics and use environment. Particularly in a case of a roll sheet, curling is likely to occur. When a curled print medium is conveyed onto the stacking portion, the stackability decreases, which may cause a jam or a projection of the print medium from the stacking portion. Japanese Patent Laid-Open No. 2014-48530 discloses a technique of improving the stackability by providing a member that guides a print medium to be discharged onto a stacking portion. Japanese Patent Laid-Open No. 2016-5983 discloses a technique in which a pivot member that suppresses a projection of a print medium from a stacking portion is provided.

As represented by a printing apparatus that cuts and discharges a roll sheet, in a printing apparatus that discharges a print medium longer than the total length of a stacking portion, the print medium is stacked on the stacking portion with a part thereof protruding from the stacking portion. In such a printing apparatus, for example, the end portion of a print medium riding on the top surface of the apparatus leads to a decrease in the stackability of the stacking portion. Therefore, there is room for improvement in terms of the stackability of a print medium.

SUMMARY OF THE INVENTION

The present invention provides a technique of improving the stackability of a printed print medium on a stacking portion.

According to an aspect of the present invention, there is provided a printing apparatus comprising: a stacking portion on which a print medium printed by a printing unit configured to perform printing is stacked; a discharge unit configured to convey the print medium printed by the printing unit to the stacking portion; a passage forming portion arranged above the stacking portion so as to face the stacking portion and configured to form a discharge passage of the print medium together with the stacking portion; and an outlet port located in a downstream end of the discharge passage in a conveying direction of the print medium, wherein in the outlet port, the passage forming portion extends to the downstream side of the stacking portion in the conveying direction.

Further features of the present invention will become apparent from the following description of exemplary embodiments (with reference to the attached drawings).

DESCRIPTION OF THE EMBODIMENTS

Figure 1:
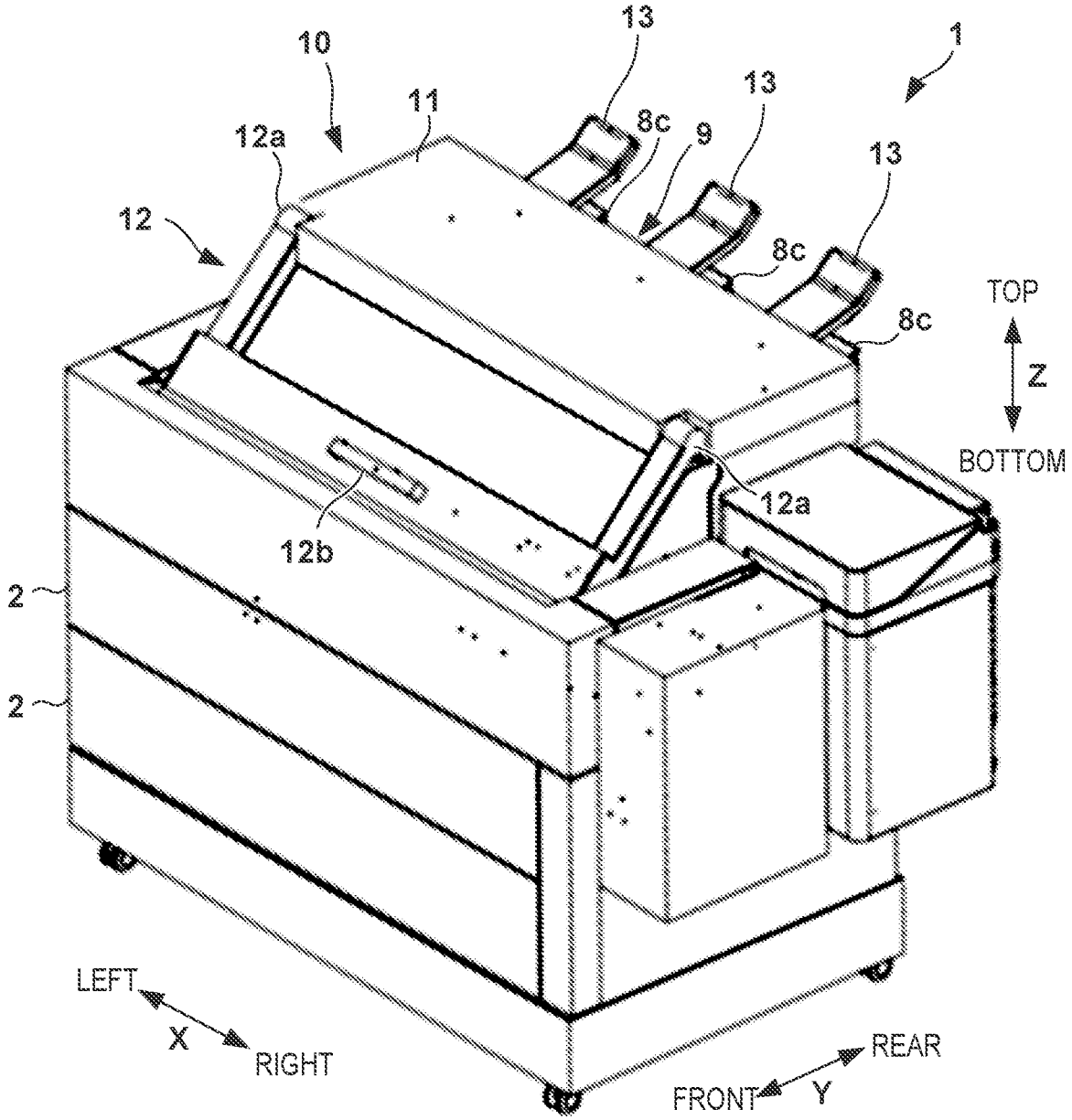
FIG. 1 is an external perspective view of a printing apparatus according to an embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

<Outline of Printing Apparatus>

Figure 2:
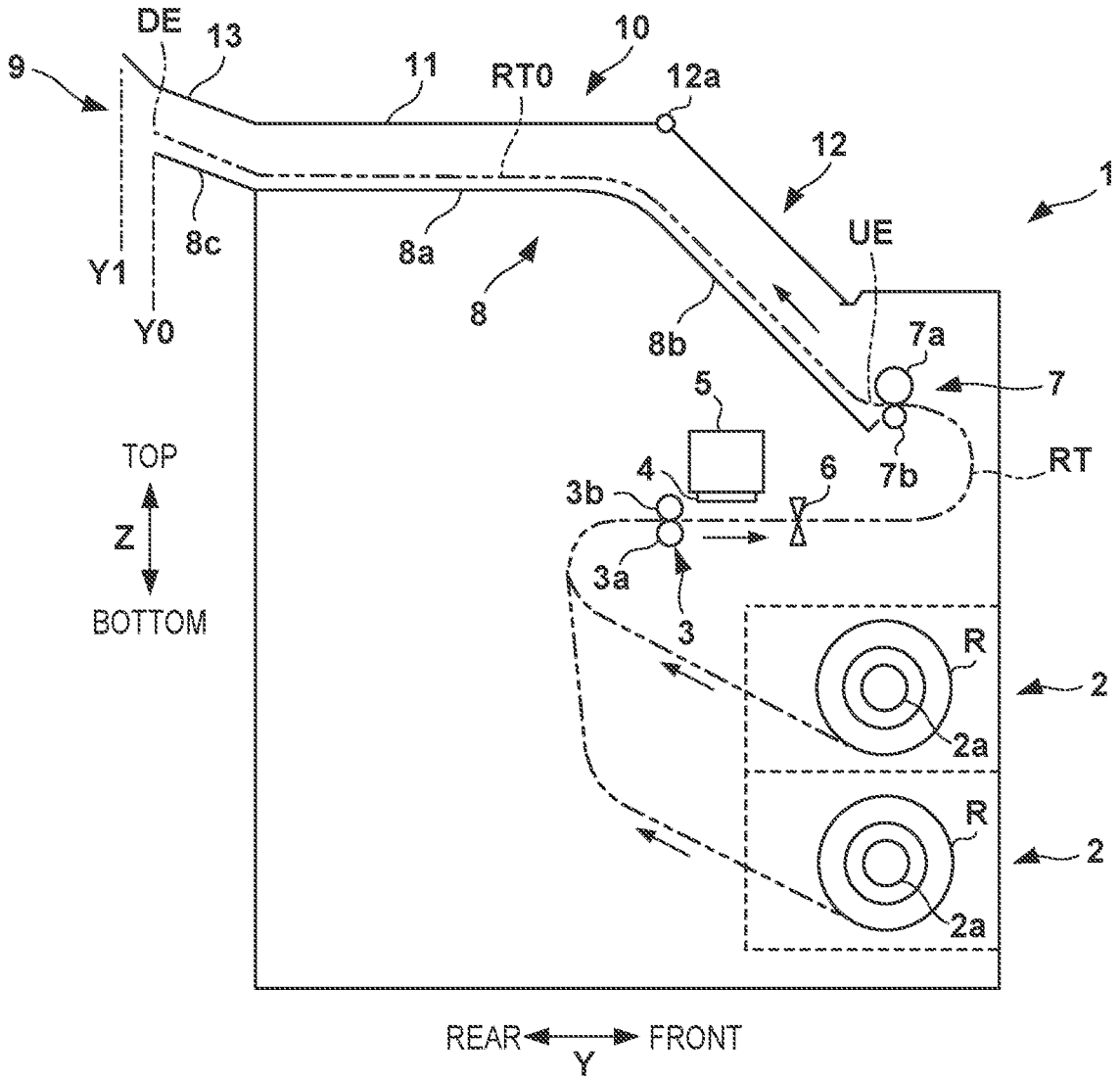
FIG. 2 is a schematic view showing the internal structure of the printing apparatus shown in FIG. 1.

FIG. 1 is an external perspective view of a printing apparatus 1 according to an embodiment of the present invention, and FIG. 2 is a schematic view showing the internal structure of the printing apparatus 1. An arrow X indicates the widthwise direction (left-and-right direction) of the printing apparatus 1, an arrow Y indicates the depth direction (front-and-rear direction) of the printing apparatus 1, and an arrow Z indicates the vertical direction. Note that "printing" includes not only forming significant information such as characters and graphics but also forming images, figures, patterns, and the like on print media in a broad sense, or processing print media, regardless of whether the information formed is significant or insignificant or whether the information formed is visualized so that a human can visually perceive it. In addition, although in this embodiment, sheet-like paper is assumed as a "print medium" serving as a print target, sheet-like cloth, plastic film, and the like may be used as print media.

In the lower portion of the printing apparatus 1, a plurality of feeding units 2 are vertically arranged in a plurality of stages (two stages in this example). Each feeding unit 2 forms a storage portion that stores a roll sheet R as a print medium. Each feeding unit 2 includes a support portion 2*a* that supports the roll sheet R so as to be rotatable around the X-direction axis, and also includes a feeding mechanism (not shown) that pulls out a sheet from the roll sheet R and feeds it to a conveyance passage RT. The conveyance passage RT is a sheet passage defined by a guide structure (not shown), and extends from the feeding unit 2 to an outlet port 9 while curving in the midway. In the following description, an upstream side and a downstream side are the upstream side and the downstream side with respect to the sheet conveying direction, respectively.

In this embodiment, the outlet port 9 is located in the rear portion of the printing apparatus 1. The feeding unit 2 can be pulled out forward from the printing apparatus 1, so that the user can perform an exchange operation of the roll sheet R from the front of the printing apparatus 1. Note that in this embodiment, the roll sheet R is exemplified as the print medium, but the print medium may be a cut sheet.

The sheet pulled out from the roll sheet R is supplied via a conveying unit 3 to a position facing a printhead 4. The conveying unit 3 includes a conveying roller 3*a*, which is a driving roller, and a nip roller 3*b*, which is a driven roller pressed against the conveying roller 3*a*. While being nipped by the conveying roller 3*a* and the nip roller 3*b*, the sheet is conveyed on the conveyance passage RT in the arrow direction by rotation of the rollers.

The printhead 4 is arranged on the downstream side of the conveying unit 3. The printhead 4 in this embodiment is an inkjet printhead which prints an image on a sheet by discharging ink. The printhead 4 uses a discharge energy generating device such as an electrothermal transducer (heater) or a piezoelectric device to discharge ink from the discharge port. The printing apparatus 1 according to this embodiment is a serial scanning inkjet printing apparatus, and the printhead 4 is mounted on a carriage 5. The carriage 5 is configured to be reciprocated in the X direction (the widthwise direction of the sheet) by a driving mechanism (not shown). In the vicinity of the printhead 4, the sheet is conveyed in the Y direction. By alternately repeating intermittent conveyance of the sheet by the conveying unit 3 and an operation including moving the carriage 5 and ink discharge by the printhead 4, an image is printed on the sheet.

Note that the serial scanning printing apparatus is exemplarily shown in this embodiment, but the present invention is also applicable to a full-line printing apparatus. In this case, a long printhead extending in the widthwise direction of a sheet is used as the printhead 4. Then, by discharging ink from the printhead while continuously conveying the sheet, an image is printed on the sheet. Further, although the inkjet printing apparatus is exemplarily shown in this embodiment, the present invention is also applicable to printing apparatuses of other printing types.

A cutting unit 6 is arranged on the downstream side of the printhead 4. The cutting unit 6 cuts the sheet, which has been pulled out from the roll sheet R and has an image printed thereon, in the widthwise direction of the sheet. Further, a discharge unit 7 is arranged on the downstream side of the cutting unit 6. The conveyance passage RT extending from the printing unit 4 to the discharge unit 7 has a U-shape (an inverted C-shape in the side view shown in FIG. 2).

The discharge unit 7 includes a discharge roller 7*a*, which is a driving roller, and a nip roller 7*b* pressed against the discharge roller 7*a*. A stacking portion 8 is arranged on the downstream side of the discharge unit 7, and the discharge unit 7 conveys, to the stacking portion 8, the sheet with the image printed thereon by the printhead 4. The sheet is cut into a cut sheet by the cutting unit 6 in the process of conveyance to the stacking portion 8 by the discharge unit 7, passes through the discharge unit 7, and is stacked on the stacking portion 8. The stacking portion 8 forms a tray which receives a plurality of sheets discharged from the discharge unit 7. The stacking portion 8 is arranged inside the printing apparatus 1.

A passage forming portion 10 is arranged so as to face the stacking portion 8 in the Z direction and forms, together with the stacking portion 8, a discharge passage RTO (a part of the conveyance passage RT) extending from the discharge unit 7 to the outlet port 9. Both side portions of the discharge passage RTO in the X direction are closed, so the user cannot access the discharge passage RTO from the outside. The outlet port 9, which is the downstream end of the discharge passage RTO, is formed by a gap between the downstream end of the passage forming portion 10 and the downstream end of the stacking portion 8 in the rear portion of the printing apparatus 1. The passage forming portion 10 also forms the top portion (top) of the printing apparatus 1. The passage forming portion 10 is formed so as to guide the sheet to the downstream side of the discharge passage RTO while suppressing floating of the sheet discharged from the discharge unit 7 and occurrence of a jam thereof. The passage forming portion 10 and the stacking portion 8 form the discharge passage RTO which is almost horizontal in the rear portion in the Y direction and slopes upward toward the rear portion in the front portion in the Y direction.

The gap between the stacking portion 8 and the passage forming portion 10 is related to the number of sheets stackable on the stacking portion 8. For example, in a specification in which a hundred sheets each having a thickness of 0.1 mm are stacked, the gap between the stacking portion 8 and the passage forming portion 10 is formed to be equal to or larger than 10 mm. Particularly, the sheet pulled out from the roll sheet R and cut tends to curl in the leading end. The gap between the stacking portion 8 and the passage forming portion 10 is designed in consideration of such curling. For example, the gap between the stacking portion 8 and the passage forming portion 10 can be designed to be equal to or smaller than the radius of the winding core of the roll sheet R so the sheet does not curl on the stacking portion 8.

<Guidance of Print Medium to Be Discharged>

Figure 3:
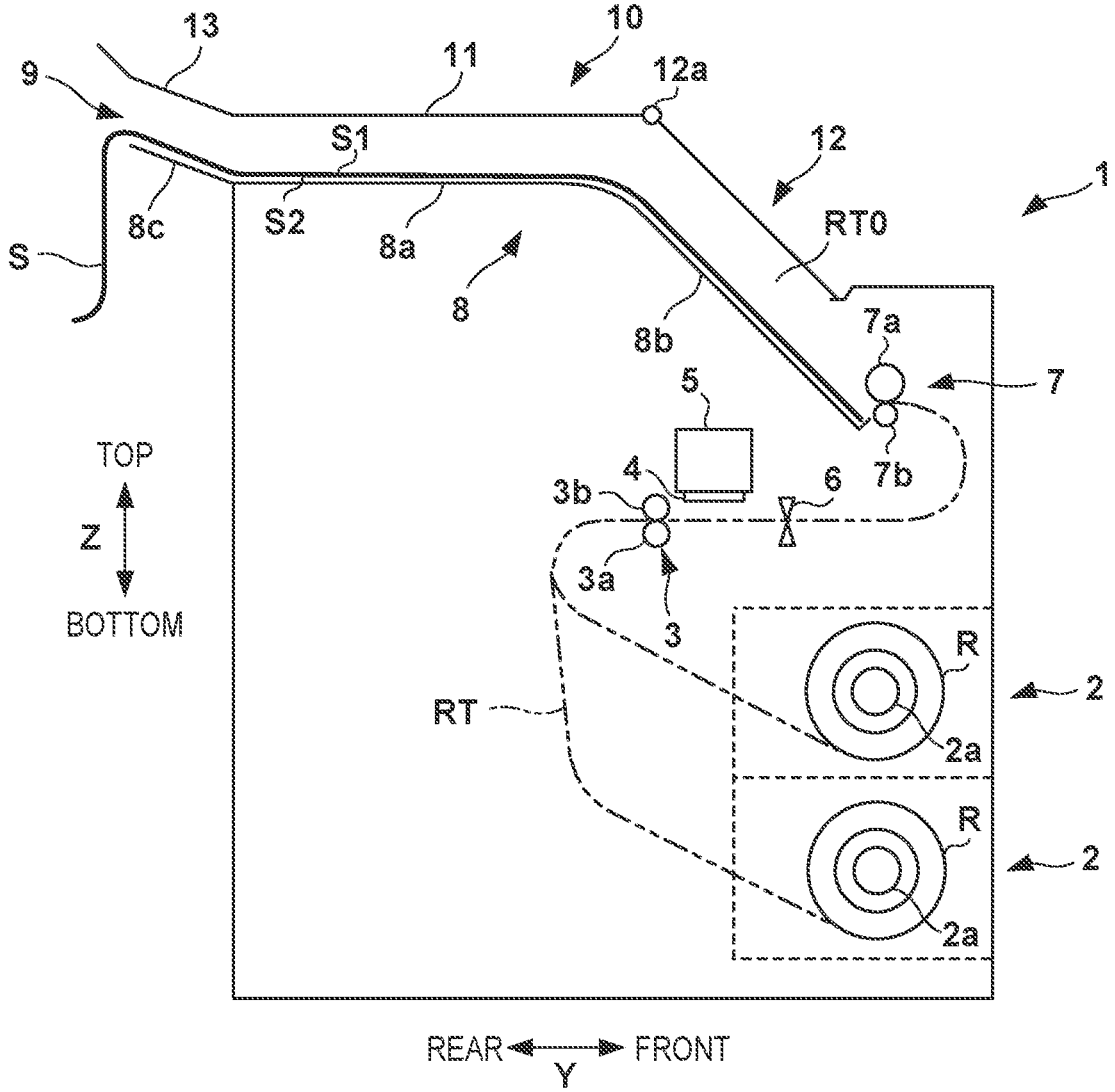
FIG. 3 is a view for explaining an operation of the printing apparatus shown in FIG. 1.

FIG. 3 shows a mode in which a printed sheet S is stacked on the stacking portion 8. In the illustrated example, the long sheet S longer than the total length of the stacking portion 8 (the passage length of the discharge passage RTO) is stacked on the stacking portion 8. A part (leading end portion) of the sheet S protrudes from the outlet port 9 and hangs down due to its own weight. As will be described below, the printing apparatus 1 according to this embodiment has the arrangement that improves the stackability in accordance with such the long sheet S. Note that the sheet S includes a surface S1 as the obverse surface and an opposite surface S2 as the reverse surface. The surface S1 is the inner surface of the roll sheet R in the radial direction, and the surface S2 is the outer surface thereof. In the arrangement according to this embodiment, the surface S1 is the upper surface of the sheet S and the surface S2 is the lower surface thereof on the stacking portion 8. During conveyance in the discharge passage RTO, the curling direction of the leading end of the sheet S due to the curl of the roll sheet R is an upward direction (a clockwise direction in the side view shown in each of FIGS. 2 and 3).

Figure 4A:
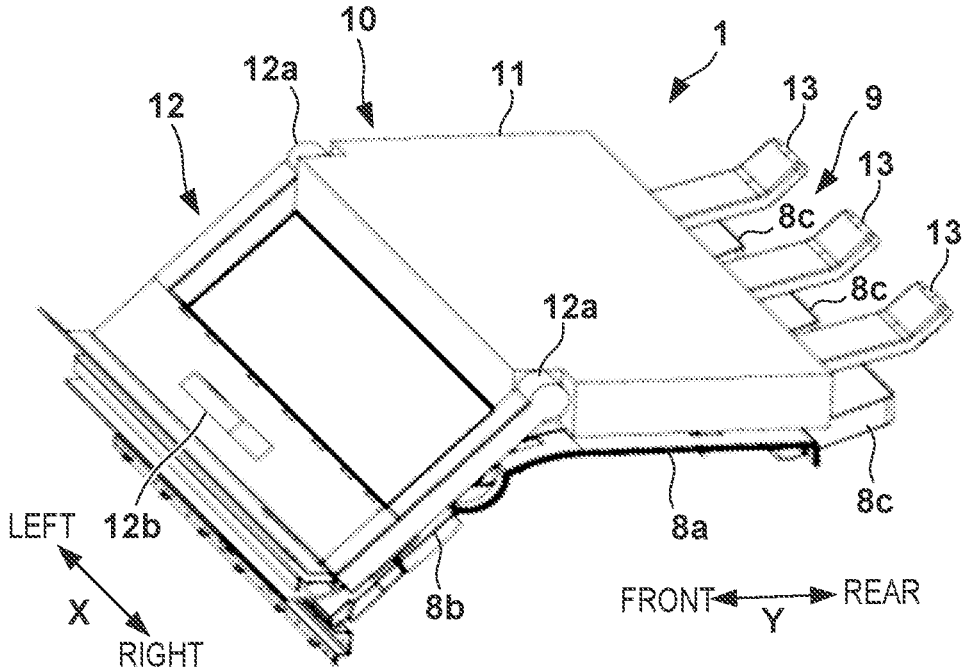
FIG. 4A is a partially cutaway perspective view showing the top portion of the printing apparatus shown in FIG. 1.
Figure 4B:
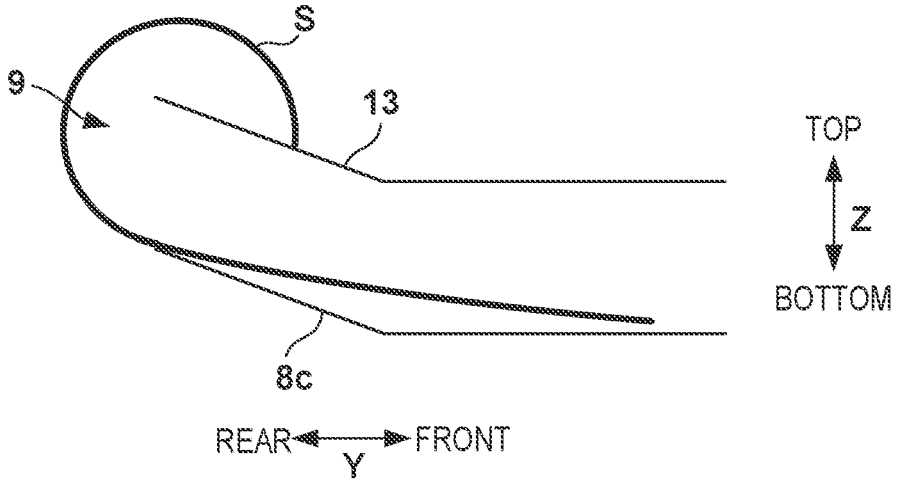
FIG. 4B is a view showing an example in which a sheet rides on the top portion of the printing apparatus.

Refer to FIGS. 1 to 4A. FIG. 4A is a partially cutaway perspective view showing the top portion of the printing apparatus 1. The passage forming portion 10 includes a fixed portion 11 at the center in the Y direction, an opening/closing portion 12 on the front side in the Y direction, and extending portions 13 on the rear side in the Y direction. Each of the fixed portion 11 and the opening/closing portion 12 is continuously formed in the X direction, and the extending portions 13 are formed intermittently in the X direction. In this embodiment, the extending portions 13 are formed at three positions. Note that the extending portion 13 may also be continuously formed in the X direction. The fixed portion 11, the opening/closing portion 12, and the extending portions 13 form the top wall of the discharge passage RTO, and guide the sheet S in the conveying direction thereof.

Each of the fixed portion 11 and the extending portion 13 is an immovable part which cannot be opened and closed. The opening/closing portion 12 is a movable part that is connected to the fixed portion 11 via a hinge portion 12*a*. The hinge portion 12*a* forms a pivot axis in the X direction, and the opening/closing portion 12 can pivot around the pivot axis of the hinge portion 12*a*. The opening/closing portion 12 is provided with a handle 12*b*, and the user can perform an opening/closing operation of the opening/closing portion 12 by grasping the handle 12*b*. When the opening/closing portion 12 is caused to pivot to the open position, the discharge passage RTO is exposed, and the user can perform a maintenance operation such as cancellation of a jam. The extending portion 13 extends obliquely upward from the fixed portion 11 toward the downstream side.

The stacking portion 8 includes an inclined portion 8*b*, a horizontal portion 8*a*, and extending portions 8*c* from the upstream side to the downstream side. When viewed in the Y direction, the inclined portion 8*b*, the horizontal portion 8*a*, and the extending portions 8*c* are arranged in this order from the front side to the rear side. Each of the horizontal portion 8*a* and the inclined portion 8*b* is continuously formed in the X direction, and the extending portions 8*c* are intermittently formed in the X direction. In this embodiment, the extending portions 8*c* are formed at three positions. Note that the extending portion 8*c* may also be continuously formed in the X direction. The horizontal portion 8*a*, the inclined portion 8*b*, and the extending portions 8*c* form the bottom wall of the discharge passage RTO, and guide the sheet S in the conveying direction thereof.

The inclined portion 8*b* is located at a position facing the opening/closing portion 12, and inclined upward from immediately after the discharge unit 7 toward the rear in the Y direction. The horizontal portion 8*a* is located at a position facing the fixed portion 11, and extends almost horizontally in the Y direction. The three extending portions 8*c* are located at positions facing the three extending portions 13 so as to correspond to them, respectively, and extend upward toward the rear in the Y direction.

The discharge passage RTO formed by the passage forming portion 10 and the stacking portion 8 as described above is a passage which is obliquely inclined in the upstream-side portion and the downstream-side portion and almost horizontal in the central portion, and its downstream end DE is located at a higher position than its upstream end UE in the Z direction. Accordingly, as exemplarily shown in FIG. 3, even in a case in which the leading end of the sheet S protrudes out of the printing apparatus 1 and hangs down, the upstream-side end portion of the sheet S is likely to stay in the inclined portion 8*b*. Further, the inclination of the extending portion 8*c* also acts to return the sheet S to the upstream side, so that it can be prevented that the entire sheet S falls off from the printing apparatus 1.

Note that the gap between the extending portion 13 and the extending portion 8*c* may be larger than the gap between the fixed portion 11 and the horizontal portion 8*a* and the gap between the opening/closing portion 12 and the inclined portion 8*b*. In other words, the spacing in the Z direction in the downstream-side end portion of the discharge passage RTO may be larger than in the remaining portion. In the case in which the leading end of the sheet S hangs down to the outside of the printing apparatus 1 as in the example shown in FIG. 3, the sheet S may curve in the downstream end of the extending portion 8*c* and a gap may be generated between the sheet S and the extending portion 8*c*. As a result, if a large number of sheets S are stacked on the stacking portion 8, the margin in the Z-direction width of the discharge passage RTO with respect to the thickness of the bundle of sheets S is lost in the downstream end of the discharge passage RTO, and a jam may occur. By increasing the gap between the extending portion 13 and the extending portion 8*c*, the margin is generated in the Z-direction width of the discharge passage RTO and occurrence of a jam can be avoided.

FIG. 2 shows a position Y0 of the downstream end of the extending portion 8*c* and a position Y1 of the downstream end of the extending portion 13. The position Y1 is located more rearward than the position 0 in the Y direction. That is, in the outlet port 9, the extending portion 13 of the passage forming portion 10 extends to the downstream side of the extending portion 8*c* of the stacking portion 8. The distance difference between the position Y0 and the position Y1 in the Y direction is, for example, equal to or larger than the diameter of the winding core of the roll sheet R. With this, it can be prevented that the curled sheet S rides on the top surface of the printing apparatus 1. As a comparative example, FIG. 4B exemplarily shows an example in which the sheet S rides on the extending portion 13 when the position Y0 of the downstream end of the extending portion 8*c* and the position Y1 of the downstream end of the extending portion 13 are located at the same position in the Y direction. In this situation, the preceding sheet S, riding on the extending portion 13 hinders discharge of the succeeding sheet S, so that a jam may occur.

Figure 5A:
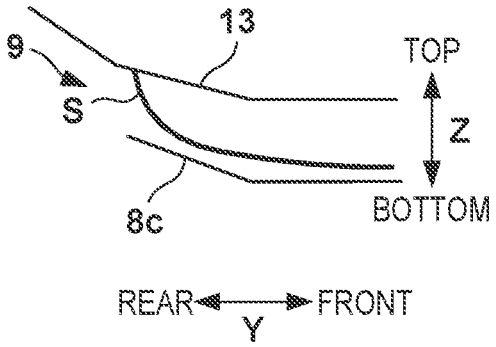
FIGS. 5A to 5F are views showing an example of a sheet guidance mode.
Figure 5D:
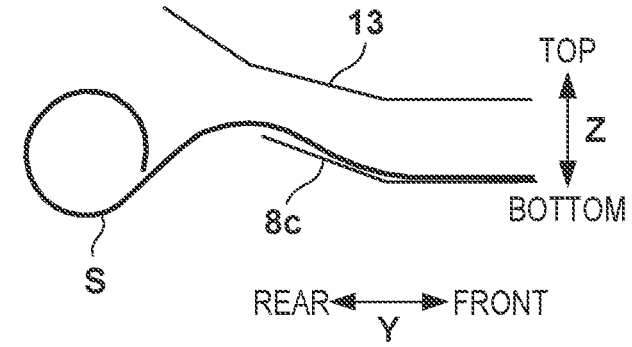
Figure 5B:
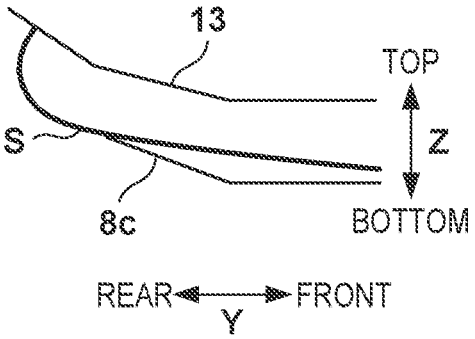

FIGS. 5A to 5F show an example of guidance of the sheet S during discharge using the arrangement according to this embodiment. FIG. 5A shows a state immediately before the discharge, from the outlet port 9, of the sheet S whose leading end curls upward. The leading end of the sheet S abuts against the extending portion 13 and its curling is suppressed. FIG. 5B shows a state in which the discharge of the sheet S has progressed from the state shown in FIG. 5A. Since the extending portion 13 extends more rearward than the extending portion 8*c*, the leading end of the sheet S still abuts against the extending portion 13 but exits the extending portion 8*c*.

Figure 5E:
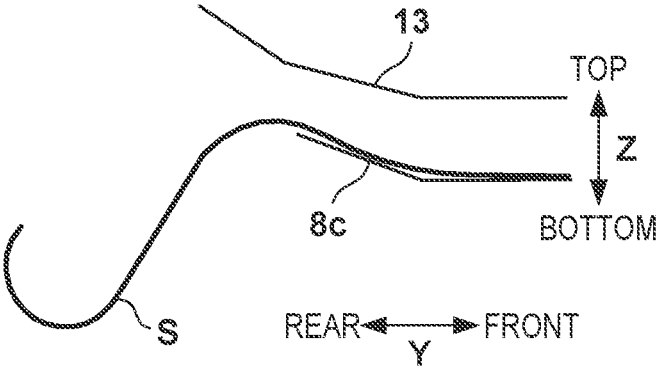
Figure 5C:
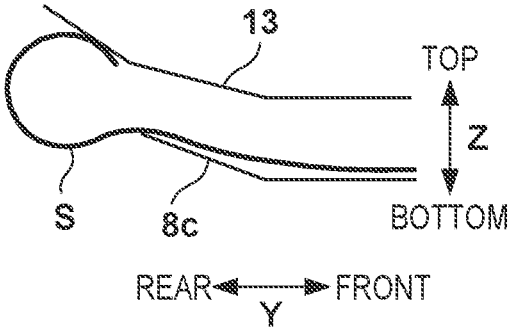

FIG. 5C shows a state in which the discharge of the sheet S has further progressed. Since the leading end portion of the sheet S exits the extending portion 8*c*, the leading end portion of the sheet S loses the lower guidance. Therefore, although the leading end portion of the sheet S abuts against the extending portion 13, it starts to curl while bulging downward due to its own weight. Thus, the leading end of the sheet S does not wrap around the top surface of the printing apparatus 1 as in the example shown in FIG. 4B.

Figure 5F:
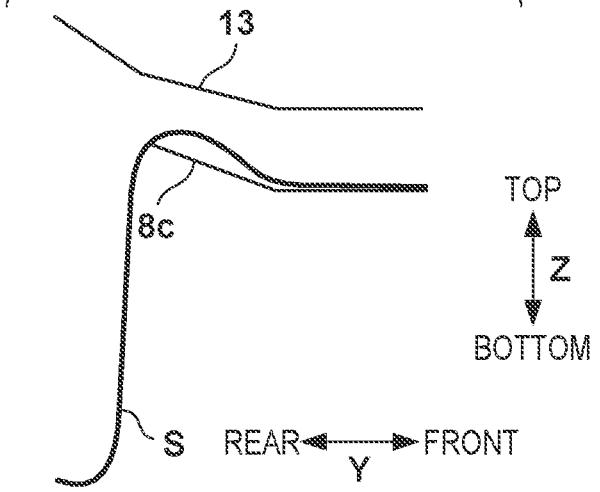

FIG. 5D shows a state in which the discharge of the sheet S has further progressed. The length of the sheet S discharged from the outlet port 9 is increased, and the leading end portion of the sheet S starts to fall downward due to its own weight. Then, the state changes as shown in FIGS. 5E and 5F, and becomes a state in which the leading end portion of the sheet S hangs down from the outlet port 9. When the upstream-side end portion of the sheet S exits the discharge unit 7, the discharge of the sheet S is completed and the sheet S rests in the posture shown in FIG. 5F.

As has been described above, according to this embodiment, even the long sheet S can be stably discharged, and the stackability of the sheet S on the stacking portion 8 can be improved.

Second Embodiment

Figure 6A:
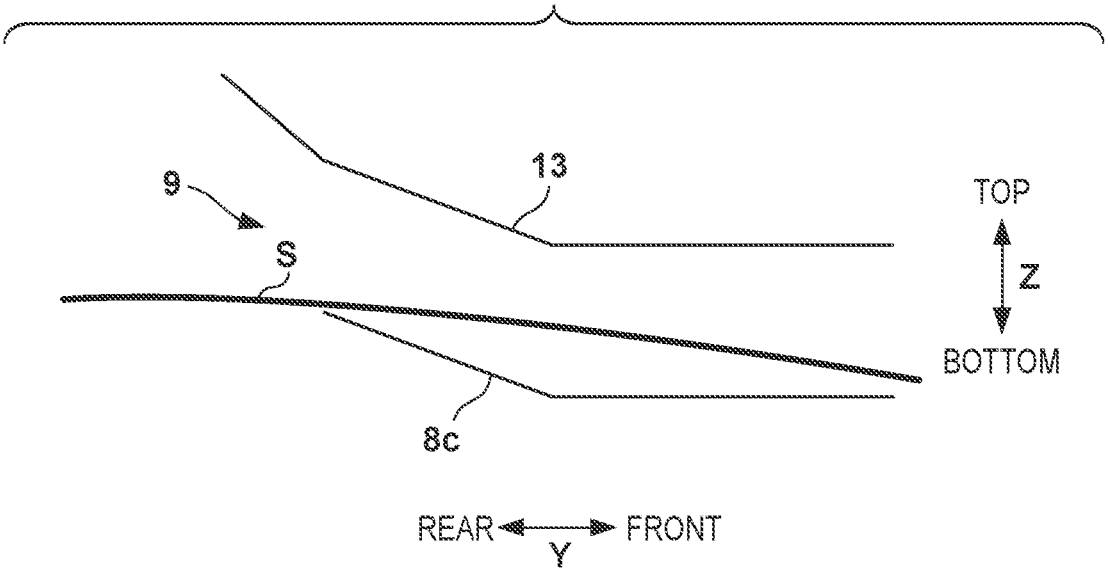
FIG. 6A is a view showing an example of projection of a sheet.

In the discharge process of the sheet S, the projection amount of the sheet S from the outlet port 9 may be large depending on the state of the sheet S. FIG. 6A shows an example in which the sheet S projects from the outlet port 9 in a nearly horizontal posture. If an obstacle such as a wall exists behind the outlet port 9, the sheet S may come into contact with the obstacle, and the sheet S may be scratched. A contact between the sheet S and the obstacle can be avoided by installing the printing apparatus 1 away from the obstacle, but this causes a restriction on the installation of the printing apparatus 1. In this embodiment, an arrangement example will be described in which the sheet S is guided downward from the outlet port 9.

Figure 6B:
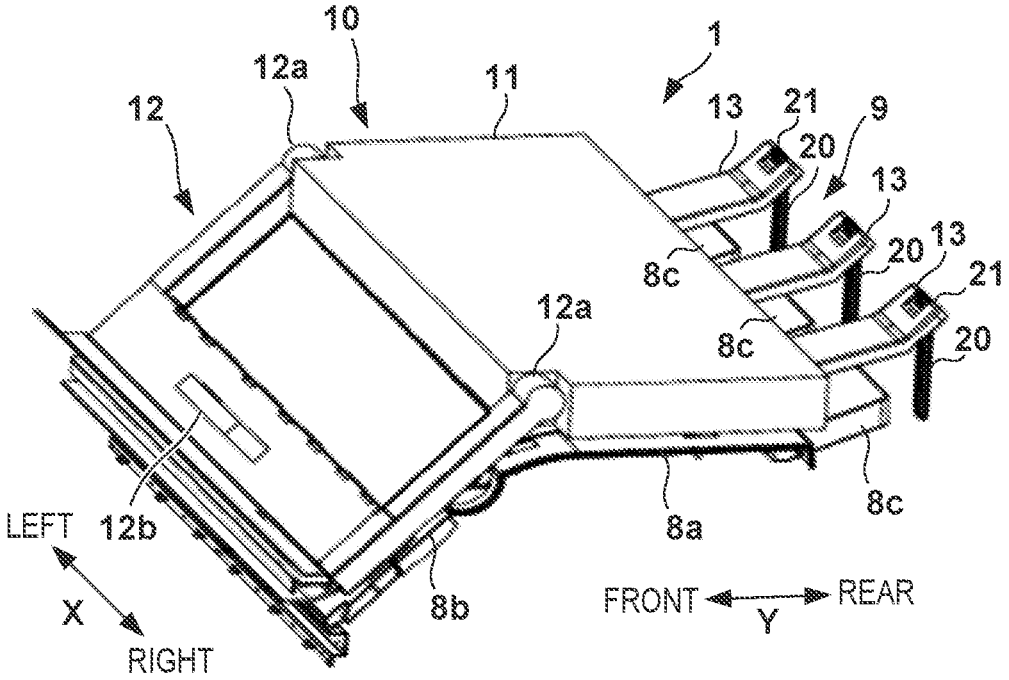
FIG. 6B is a perspective view showing the top portion of a printing apparatus according to the second embodiment.
Figure 7:
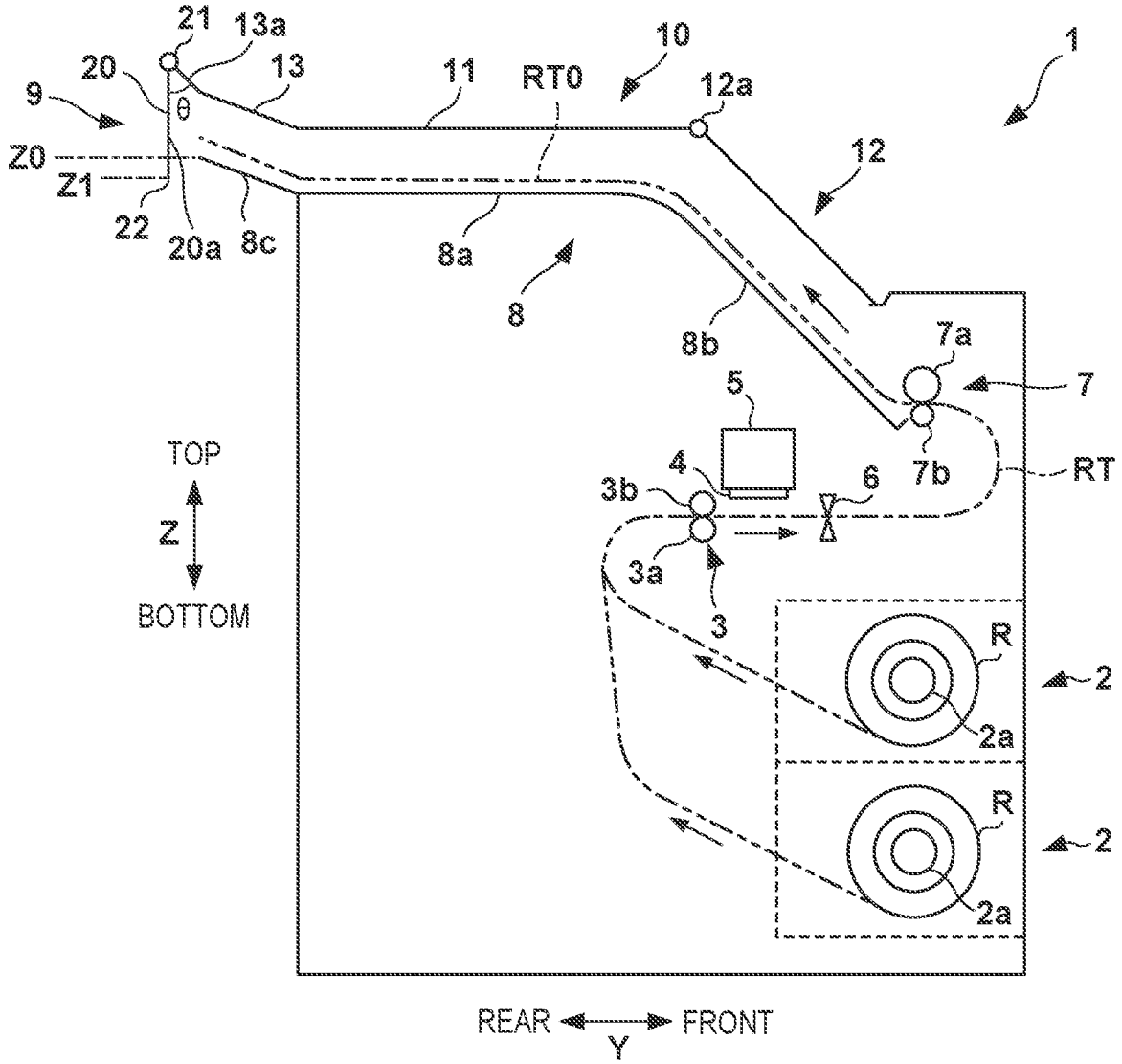
FIG. 7 is a schematic view showing the internal structure of the printing apparatus according to the second embodiment shown in FIG. 6B.

FIG. 6B is a partially cutaway perspective view showing the top portion of a printing apparatus 1 according to this embodiment, and FIG. 7 is a schematic view showing the internal structure of the printing apparatus 1 according to this embodiment. The arrangement different from that in the first embodiment will be described.

In the printing apparatus 1 according to this embodiment, guide members 20 are provided in the downstream-side end portion of a passage forming portion 10. In the illustrated example, each guide member 20 is provided in the downstream end of each extending portion 13. The guide member 20 is a flat plate member, and its upper end portion is supported in the extending portion 13 by a hinge portion 21 so as to be pivotable in the vertical direction. The hinge portion 21 forms the pivot axis in the X direction. The guide member 20 is provided so as to cover an outlet port 9 and is separated from an extending portion 8*c* in the Y direction. Therefore, the guide member 20 can guide a sheet S discharged from a discharge passage RTO and abutting against the guide member 20. A Z-direction position Z1 of a lower end 22 of the guide member 20 is lower than a Z-direction position Z0 of the downstream end of the extending portion 8*c*, so that the sheet S discharged from the outlet port 9 can be guided downward without interruption.

The extending portion 13 includes a guide surface 13*a* directed upward from the upstream side to the downstream side. The guide member 20 includes a guide surface 20*a*, which is a vertical surface in a natural state (a state in which no sheet abuts against it) and forms an acute angle θ with the guide surface 13*a*. Since the guide surface 13*a* and the guide surface 20*a* form the acute angle θ, the leading end of the curled sheet S can be guided inward on these guide surfaces. This can suppress that the sheet S projects rearward from the outlet port 9.

Figure 8A:
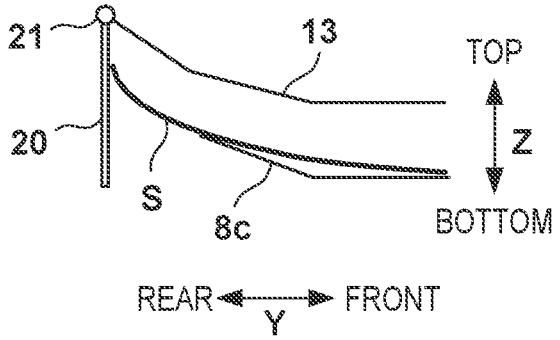
FIGS. 8A to 8F are views showing an example of a sheet guidance mode.
Figure 8D:
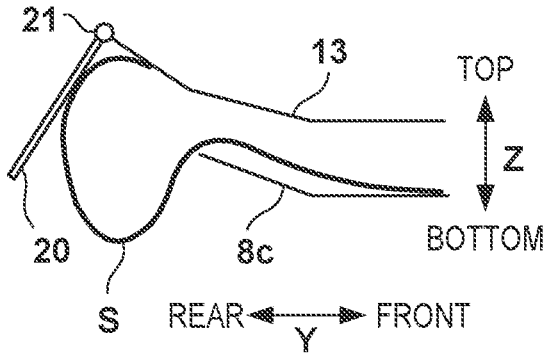
Figure 8B:
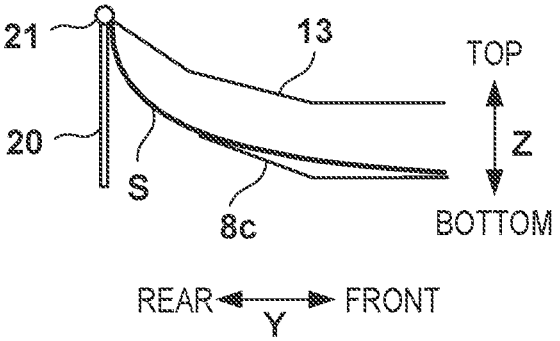

FIGS. 8A to 8F show an example of guidance of the sheet S during discharge using the arrangement according to this embodiment. FIG. 8A shows a state immediately before the discharge, from the outlet port 9, of the sheet S whose leading end curls upward. The leading end of the sheet S abuts against the guide member 20 so that it is suppressed that the leading end projects rearward from the outlet port 9. FIG. 8B shows a state in which the discharge of the sheet S has progressed from the state shown in FIG. 8A. Since the leading end portion of the sheet S curls upward, the leading end of the sheet S rises along the guide member 20 and reaches near the hinge portion 21.

Figure 8E:
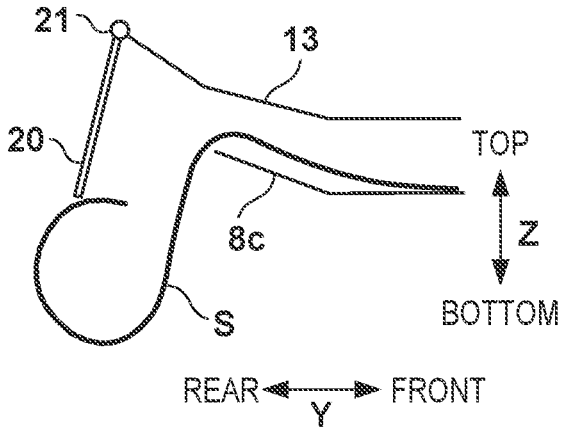
Figure 8C:
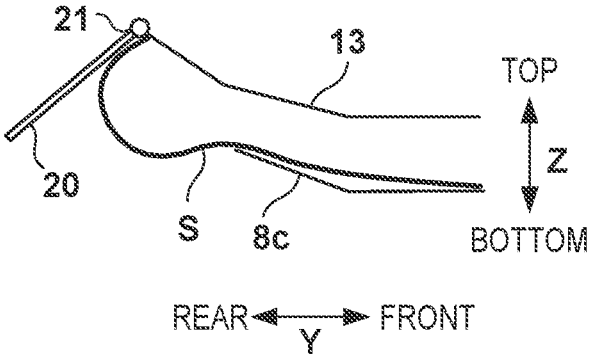

FIG. 8C shows a state in which the discharge of the sheet S has further progressed. Since the leading end of the sheet S cannot move more upward than the hinge portion 21, the leading end portion of the sheet S starts to curl while bulging downward due to its own weight. At this time, the guide member 20 is pressed by the sheet S and caused to pivot. This can prevent the guide member 20 from causing occurrence of a jam of the sheet S.

Figure 8F:
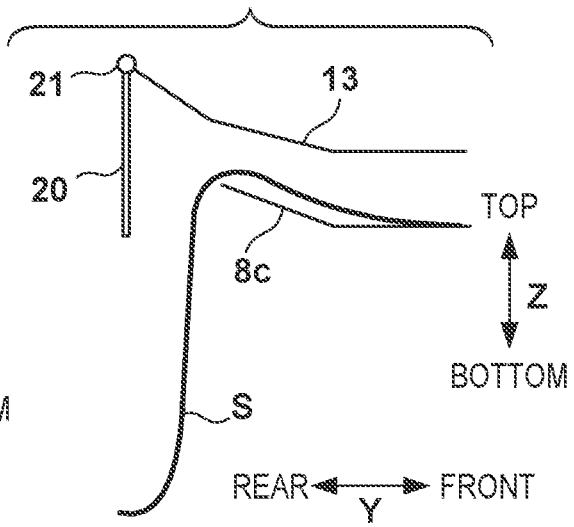

FIG. 8D shows a state in which the discharge of the sheet S has further progressed. The length of the sheet S discharged from the outlet port 9 is increased, and the leading end portion of the sheet S starts to fall downward due to its own weight. Then, the state changes as shown in FIGS. 8E and 8F, and becomes a state in which the leading end portion of the sheet S hangs down from the outlet port 9. When the upstream-side end portion of the sheet S exits the discharge unit 7, the discharge of the sheet S is completed and the sheet S rests in the posture shown in FIG. 8F. The guide member 20 pivots due to its own weight and returns to the original posture.

As has been described above, in this embodiment, it is suppressed that the sheet S largely protrudes behind the printing apparatus 1. This can improve the stackability of the sheet S on the stacking portion 8.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-166107, filed Sep. 30, 2020, which is hereby incorporated by reference herein in its entirety.

What is claimed is:

1. A printing apparatus comprising:

a stacking portion on which a print medium printed by a printing unit configured to perform printing is stacked;

a discharge unit configured to convey the print medium printed by the printing unit to the stacking portion in a conveying direction;

a passage forming portion arranged above the stacking portion so as to face the stacking portion, configured to form a discharge passage of the print medium together with the stacking portion, and including a first portion and a plurality of second portions located downstream of the first portion; and guide members supported by the second portions so as to be pivotable in accordance with contact with the print medium, wherein the second portions are separated from each other in a direction intersecting with the conveying direction, and the first portion is continuously formed in the direction intersecting with the conveying direction, a downstream end of each of the second portions in the conveying direction is located further downstream of a downstream end of the stacking portion in the conveying direction, the guide members are configured to downwardly guide the print medium discharged from the discharge passage, each of the second portions includes a first guide surface extending upward from an upstream side to a downstream side in the conveying direction, and each of the guide members includes a second guide surface which forms an acute angle with the first guide surface.

2. The apparatus according to claim 1, further comprising:

a storage portion configured to store a roll sheet; and a cutting unit configured to cut a sheet pulled out from the roll sheet, wherein the sheet pulled out from the roll sheet is supplied to the printing unit, and the sheet cut by the cutting unit is stacked as the print medium on the stacking portion.

3. The apparatus according to claim 1, wherein a downstream end of the discharge passage in the conveying direction is located at a higher position than an upstream end of the discharge passage.

4. The apparatus according to claim 2, wherein the sheet includes a first surface and a second surface on an opposite side, the first surface is an inward surface of the roll sheet in a radial direction of the roll sheet, and on the stacking portion, an upper surface of the sheet is the first surface.

5. The apparatus according to claim 1, further comprising:

an outlet port located at a downstream end of the discharge passage in the conveying direction and between the downstream end of the passage forming portion and the downstream end of the stacking portion, the print medium conveyed by the discharge unit being discharged outside the discharge passage from the outlet port, wherein a lower end of each guide member is located at a lower position than that of the outlet port.

6. The apparatus according to claim 1, wherein the discharge passage is arranged above the printing unit and overlaps with the printing unit in a vertical direction.

7. The apparatus according to claim 1, wherein each guide member is a flat plate member and is pivotable about an axis intersecting with the conveying direction.

8. The apparatus according to claim 1, wherein the passage forming portion is formed so that the print medium abuts against the passage forming portion while the print medium is conveyed by the discharge unit.

9. The apparatus according to claim 1, wherein the second guide surface is a vertical surface when in a state in which the print medium does not abut against the second guide surface.

10. The apparatus according to claim 1, further comprising an outlet port located at a downstream end of the discharge passage in the conveying direction and between the downstream end of the passage forming portion and the downstream end of the stacking portion, the print medium conveyed by the discharge unit being discharged outside the discharge passage from the outlet port.

11. The apparatus according to claim 10, wherein the outlet port is located in a rear portion of the printing apparatus.

12. The apparatus according to claim 1, wherein the printing unit is configured to perform printing by discharging ink on the print medium.

* * * * *